US007045036B2

(12) United States Patent
Lipponen et al.

(10) Patent No.: US 7,045,036 B2
(45) Date of Patent: May 16, 2006

(54) METHOD AND APPARATUS FOR PRODUCING SIZED PAPER OF BOARD

(75) Inventors: Juha Lipponen, Kerava (FI); Johan Grön, Espoo (FI); Sami Anttilainen, Jyväskylä (FI); Juha S. Kinnunen, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 12 days.

(21) Appl. No.: 10/482,509

(22) PCT Filed: Jun. 28, 2002

(86) PCT No.: PCT/FI02/00578

§ 371 (c)(1),
(2), (4) Date: Feb. 11, 2004

(87) PCT Pub. No.: WO03/004769

PCT Pub. Date: Jan. 16, 2003

(65) Prior Publication Data

US 2004/0177939 A1 Sep. 16, 2004

(30) Foreign Application Priority Data

Jul. 3, 2001 (FI) ..... 20011454

(51) Int. Cl.
*D21H 23/22* (2006.01)

(52) U.S. Cl. ..... 162/135; 162/158; 162/184; 162/205; 162/265; 427/428.01; 427/421.1; 118/76; 118/300; 118/322

(58) Field of Classification Search ..... 162/135–137, 162/158, 175, 204–207, 183–184; 427/211, 427/428.01, 428.2, 361, 391, 421.1; 118/76–77, 118/109, 110, 118, 200, 300, 322
See application file for complete search history.

(56) References Cited

U.S. PATENT DOCUMENTS

| | | | | |
|---|---|---|---|---|
| 1,662,641 | A * | 3/1928 | Hans | 162/181.3 |
| 1,966,458 | A * | 7/1934 | Novak | 162/170 |
| 1,969,592 | A * | 8/1934 | Yoerg | 162/135 |
| 2,041,285 | A * | 5/1936 | De Cew | 162/180 |
| 2,229,621 | A * | 1/1941 | Bradner | 162/184 |
| 2,309,089 | A * | 1/1943 | Bauer et al. | 162/166 |
| 2,337,459 | A * | 12/1943 | Edson et al. | 162/175 |
| 2,389,450 | A * | 2/1945 | Fisher et al. | 482/486 |

(Continued)

FOREIGN PATENT DOCUMENTS

EP 1 050 622 A2 11/2000

(Continued)

OTHER PUBLICATIONS

Papermaking Science and Technology, Book 8, p. 217.

*Primary Examiner*—José A Fortuna
(74) *Attorney, Agent, or Firm*—Cohen, Pontani, Lieberman & Pavane

(57) ABSTRACT

A method and assembly is disclosed for manufacturing a sized web of paper or paperboard, the method comprising the steps of first forming the web at a headbox (1) from a stock comprising at least water and fiber, then pressing the web for water drainage, and finally drying the web by heating. Size furnish is added to the web so that at least a portion of the overall amount of size is added to the web prior to initiating the drying of the web by heating, and at least a portion of the overall amount of size is applied to the web after initiating the drying of the web.

14 Claims, 2 Drawing Sheets

U.S. PATENT DOCUMENTS

| | | | | | |
|---|---|---|---|---|---|
| 2,378,113 | A | * | 6/1945 | Van De Carr Jr. | 162/181.1 |
| 2,772,604 | A | * | 12/1956 | Muggleton | 162/184 |
| 3,017,295 | A | * | 1/1962 | Outterson et al. | 428/337 |
| 3,321,115 | A | * | 5/1967 | Rendahl | 222/505 |
| 3,321,359 | A | * | 5/1967 | Shaughnessy | 162/175 |
| 3,413,190 | A | * | 11/1968 | Aycock et al. | 162/175 |
| 3,431,162 | A | * | 3/1969 | Morris | 428/182 |
| 3,592,730 | A | * | 7/1971 | Newman | 162/137 |
| 4,339,481 | A | * | 7/1982 | Beekhuis | 427/428.1 |
| 4,503,802 | A | * | 3/1985 | Keller et al. | 118/249 |
| 4,973,441 | A | * | 11/1990 | Keller | 264/280 |
| 4,983,257 | A | * | 1/1991 | Schultz et al. | 162/158 |
| 5,308,441 | A | | 5/1994 | Kern | |
| 5,753,078 | A | * | 5/1998 | Koutitonsky et al. | 162/135 |
| 5,985,030 | A | | 11/1999 | Taylor et al. | |
| 6,027,611 | A | * | 2/2000 | McFarland et al. | 162/127 |
| 6,177,137 | B1 | * | 1/2001 | Rantanen | 427/348 |
| 6,187,142 | B1 | * | 2/2001 | Heinzmann et al. | 162/135 |
| 6,187,143 | B1 | * | 2/2001 | Juppo et al. | 162/158 |
| 6,274,001 | B1 | * | 8/2001 | Mohan | 162/206 |
| 6,284,097 | B1 | * | 9/2001 | Wulz et al. | 162/137 |
| 6,287,424 | B1 | * | 9/2001 | Mohan et al. | 162/206 |
| 6,372,090 | B1 | * | 4/2002 | Laapotti | 162/206 |
| 6,423,181 | B1 | | 7/2002 | Mendez-Gallon | |
| 6,428,655 | B1 | * | 8/2002 | Kerttula | 162/289 |
| 6,436,234 | B1 | * | 8/2002 | Chen et al. | 162/109 |
| 6,494,988 | B1 | | 12/2002 | Cedra | |
| 6,573,203 | B1 | * | 6/2003 | McConnell et al. | 442/79 |
| 6,582,560 | B1 | * | 6/2003 | Runge et al. | 162/182 |
| 2001/0009180 | A1 | * | 7/2001 | Welch et al. | 162/158 |
| 2002/0060009 | A1 | * | 5/2002 | Wulz et al. | 162/135 |

FOREIGN PATENT DOCUMENTS

| | | |
|---|---|---|
| EP | 1 052 328 A2 | 11/2000 |
| WO | WO 99/19081 | 4/1999 |
| WO | WO 01/02098 | 1/2001 |

* cited by examiner

METHOD AND APPARATUS FOR PRODUCING SIZED PAPER OF BOARD

PRIORITY CLAIM

This is a national stage of PCT application No. PCT/FI02/00578, filed on Jun. 28, 2002. Priority is claimed on that application and on Application No. 20011454, filed in Finland on Jul. 3, 2001.

BACKGROUND OF THE INVENTION

The invention relates to a method for making sized paper or paperboard. In this kind of product, the goal is to improve the web strength by internal sizing of the web or by subjecting the web to surface sizing. Generally, a major portion of the size is starch, and sizing can substantially improve such qualities as the surface strength of the sized web, reduce its dusting propensity and increase its flexural stiffness.

The invention also relates to an assembly suited for implementing the method.

In the treatment of fine paper grades sizing forms an important step in the manufacture, like in manufacture of the liner web of corrugated board and fluting, by substantially controlling the strength properties of the finished product. Generally, size has been applied to the web surfaces and, with the increasing interest to the manufacture of multilayer products, also to the middle layers of the product in the core thereof. In fine printing papers, the function of size is to improve the imprinting qualities of the paper web surface by virtue of giving the product a higher surface strength for better durability under the stresses of a printing process and reduced dusting propensity when used in a copier machine, for instance. Different kinds of starch are generally used as size, complemented with a variety of additives. However, since the present invention is not limited to any particular size composition, size must be understood in this context to refer to all compositions that are at least partially absorbable in the base web to be treated and serve to improve the strength of the base web.

Size is conventionally applied to the web as a dilute low-solids aqueous furnish. A major complication in the efficiency improvement of machines used for making fine papers and paperboard appears to be the drainage capacity of water transported into the web along with the size furnish. Furthermore, the drying of the formed web into an end product suited for making paper or paperboard requires a substantial portion in the overall energy budget of a paper mill. Inasmuch only a limited amount of water can be removed from a moving web by a single dryer, the number of successive dryer units must be increased in proportion to the elevated web speed. The larger number of drying equipment, such as dryer cylinders for instance, drastically increases the length of the papermaking machine and, in particular, its price, whereby the acquisition of a new high-speed line for making paperboard or fine paper grades may rise so high that an investment decisions becomes futile. On the other hand, the web speed of existing machinery is limited by the available drying capacity that curtails the maximum running speed and, hence, the potential production capacity.

SUMMARY OF THE INVENTION

It is an object of the present invention to provide a method capable of reducing the drying capacity required in the manufacture of sized paper or paperboard thus making it possible to force down the investment costs and at the same time reduce the length of the papermaking line.

The goal of the invention is achieved by way of applying the size to the web in a plurality of steps so that advantageously at least a portion of the overall amount of size is applied to the intermediate plies of a web formed by a multi-ply headbox, at least a portion to the surface of the web in the press section and at least a portion downstream of the press section.

According to a preferred embodiment of the invention, the web porosity is controlled to a desired value by setting the draw between the press section and the dryer section of the machine such that the desired porosity of the web is attained.

According to another preferred embodiment of the invention, a high-solids size furnish is used for sizing the web downstream of the press section.

The invention offers significant benefits.

The invention makes it possible to significantly reduce the length of new machinery constructions used for making paper and paperboard. Such reduction in the machine length and number of machine components gives substantial savings in the investment costs. Since a major portion of the size is applied to the web in the headbox or on the press section, and the size application downstream of the press section takes place using size furnishes having a solids content higher than those used in conventional size furnishes, the amount of water imported to the web after the press section is smaller and, hence, the need for postdrying is substantially reduced as compared with size application methods wherein sizing takes place only downstream of the press section. By virtue of the invention, it is feasible to obtain a length reduction as high as 75% in the dryer section following the last size application step in the machinery. As the need for postdrying capacity per produced unit is reduced, also the competitiveness of end products on the market is increased. Size furnish applied in the headbox and on the press section does not bring much additional water to the web that still at this stage has a high moisture content and, moreover, the introduced extra water is anyhow removed on the press section. The application step performed on the press section may be implemented in conjunction with a shoe press that impregnates the web more efficiently with the size by the same token as it removes water from the web.

Size may be applied directly to the web surface and, if required, sufficient penetration of size into the web may be ensured with the help of a roll, an extended-nip press roll or a belt press. This kind of arrangement is substantially less complicated than a full-size film-transfer press. As the equipment required for the implementation of the present invention are simple and occupy a small footprint when adapted in existing machinery, an approach is provided for improving the production capacity of operational machinery at a minimal investment cost. Moreover, the technique of applying size directly to the web disposes with the need for actual applicator equipment thus allowing the size to be applied directly from the size cooker without the need for machine circulation thereof. This provides substantial savings inasmuch the size pumps, containers, piping and air separators/strainers conventionally required in recirculation become redundant. A further benefit is that size temperature can be elevated, whereby its viscosity is lower, penetration power is improved and the risk of size degradation is reduced owing to the high temperature of the size and the lack of a recirculation system.

An important feature of the present invention is its capability of combining the control of surface porosity with sizing. Web porosity can be effected vigorously by controlling the speed difference between the press section and the dryer section. Conventionally, the dryer section is driven at a speed about 3% higher than that of the press section, whereby the draw applied to the web keeps it tight and under control. If a smaller draw is used, also the web porosity becomes smaller while a higher draw increases the porosity of the web. As the web being treated still has a very high moisture content after the press section, deformations caused thereon by the draw remain permanent. Since the porosity of the web surface obviously affects quite many of the surface parameters, draw can be utilized to optimize the surface quality to meet the specifications set for the end product. In addition to its effect on the surface quality, changes in web porosity also contribute to the absorption of size in the web. While it is still unclear, whether the higher porosity improves the penetration of size into the web or decreases penetration due to reduced capillary effect, the draw required in the papermaking process to obtain optimal results end can be found experimentally.

BRIEF DESCRIPTION OF THE DRAWINGS

In the following, the invention will be examined in more detail by making reference to the appended drawings, wherein.

DETAILED DESCRIPTION OF THE PRESENTLY PREFERRED EMBODIMENTS

Figure 1:
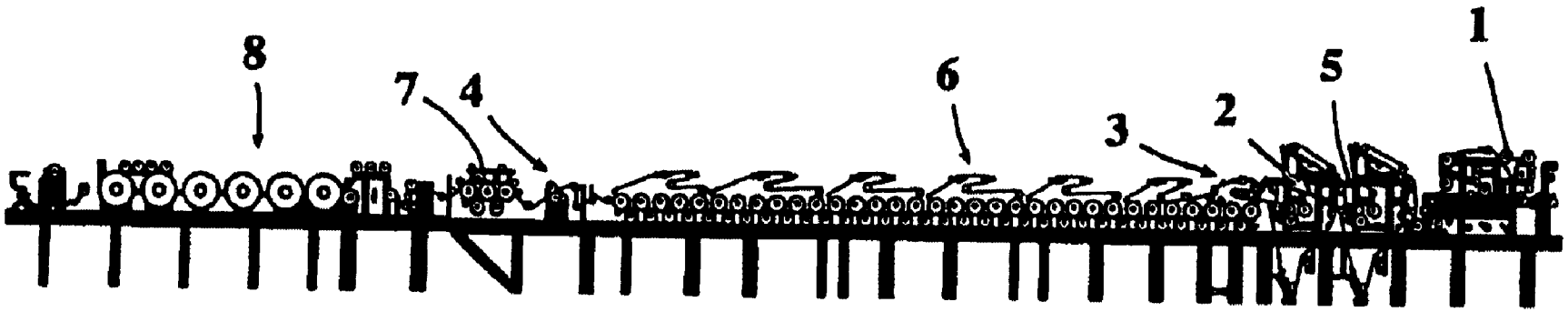
FIG. 1 shows an embodiment of the invention in a production line for the manufacture of paper or paperboard.

In FIG. 1 is shown a production line for the manufacture of paper or paperboard. The manufacture of the product starts from a headbox 1 that in the illustrated case is a multilayer headbox 1. At the headbox, the web is formed by spreading from the headbox jet nozzles fiber furnish of high water content into a gap between two parallel-running wires. In addition to water and fiber, the fiber furnish may also contain plural other components such as mineral fillers, for instance. From headbox 1 the web is passed to a press section 5 comprising a plurality of roll nips by means of which the fiber furnish forming the web is pressed between wires and felts, whereby water is drained from the furnish so that the formation of a more consistent web begins. Conventionally, the press section includes at least some extended-nip presses that offer high water drainage capability and controllability. Downstream of press section 5 the web is passed to a dryer section 3, wherein the web is dried at an elevated temperature. Among other components, the dryer section comprises cylinder groups 6 incorporating heatable cylinders and vacuum cylinders cooperating with wires and felts that guide the web travel. Downstream of the dryer section is situated a surface size applicator 4, followed by a dryer cylinder group 7 for drying the applied size. The last section in the machinery is a winder 8 with other necessary roll finishing equipment.

The above description only serves to give a notion on the general layout of a modern production line used in the manufacture of paper or paperboard. The structure of the headbox, press section, dryer section and other equipment varies by the equipment manufacturer and machine construction, but the details of this machinery are not crucial to the implementation of present invention. The only precondition in regard to the invention is that the order of equipment is as described above and that the moisture content of the web decreases downstream as the web passes the production line. An especially noteworthy observation to be made is that the interface between the press section and the dryer section divides the papermaking machine into a wet web portion and a dry web portion. Within the wet web portion, the strength of the web is very low and the fiber thereof saturated with water, whereby any deformations remain permanent and the web must be supported to avoid web breaks. When drying on the dryer section, the web assumes a dry state, whereby the fiber moisture content decreases and deformations cannot anymore be effected without high temperature and pressure. Herein, the web is also more durable under changes in the tensile stress and, hence, does not need continuous support by a wire, felt or belts.

The present invention is particularly advantageously implemented in paper and paperboard machines, wherein the web is formed in a layered fashion by means of a multilayer headbox. In this kind of headbox, the stock is fed into a gap between opposedly running wires from a nozzle assembly that further is divided into multiple layers by horizontal partitions. The fiber furnishes forming the different layers are delivered via the layered nozzles. Typically, a multilayer headbox has three or two nozzle layers that form a respective number of layers. A multilayer headbox is described in publication Papermaking Science and Technology, Book 8, page 217. A benefit of the multilayer headbox is that it allows the different layers of the web to be made from furnishes of different qualities, whereby it is substantially easier to optimize the base web properties as compared to web formation from a single kind of stock. In conjunction with the present invention, size can be added to at least one of the layers in order to improve the web strength. Size is herein preferably added to the middle layer inasmuch sizing of the surface layers may be readily performed in the later stages of the production line. In a two- or three-layer headbox, size is most advantageously mixed into the furnish of the bottom layer, because size application to the top side of the web is easy to implement later downstream along the production line.

According to the invention, size is applied to the web surface on the press section of the machine by an applicator apparatus 2. Herein, the applicator apparatus 2 is located to operate in conjunction with the latter press of the press section so as to apply size to the underside of the web. At this stage, the size may have a high solids content, because the water drainage effected by the press also removes from the web the water imported with the size. On the travel of the web through the press section it must be noted that, since water drainage should not be performed from the sized side of the web, the porous felt or wire through which water drainage takes place must be arranged to run in the press on the opposite side of the web relative to the sized surface in order to accomplish water removal from the untreated side. Size application is advantageously performed using, e.g., a spray applicator apparatus or a MIKROJET applicator, but in principle also other application methods such as a size press could be contemplated with the penalty of high cost and large footprint requirement of the size press as compared to the preferred equipment mentioned above. The construction of a MIKROJET applicator is described in patent publication WO 01/02098 and it comprises a plate with a great number of small holes through which the agent to be applied is delivered. This apparatus performs uniform application in the cross-machine direction and can be used for controlled application of very small amounts of size or other web treatment agent. As the support element of the apparatus to be mounted in immediate vicinity of the web is only a narrow beam, the MIKROJET applicator may readily be adapted in a desired position, e.g., on the press section of the papermaking machine. However, the applicator apparatus is most advantageously placed on the press section at least prior to the last press nip in order to avail of the water drainage taking place on the press section.

At this stage, size has been applied to the web in two steps: in the headbox and on the press section. As a result, the web contains size in its middle layer and on one side of the web that in the exemplifying embodiment is the underside of the web. In order to make the web qualities at least substantially symmetrical, also the top side of the web must be sized. This step is arranged to occur downstream of dryer group 6. Herein, size is applied to the web at a substantially higher solids content than in prior-art methods so that the solids are about 15 to 40%. Depending on the size preparation technique, even higher solids may be applied with the provision that the viscosity of the size furnish does not become excessively high and the size furnish still can be passed through the applicator equipment. In practice, however, concurrent size preparation equipment can be used only for making furnishes of less than 40% solids. Due to the high solids content, the thickness of size layer applied to the web must be thin if it is not desirable to have a high amount of solids applied to the web. The size layer must further be made thin to keep the size weight low and to minimize the amount of water transported to the base web. According a preferred feature of the present invention, the amount of size applied to the web should not be greater than 5 g/m$^2$ as aqueous furnish of size applied to the web.

The applicator apparatuses suited for use in the invention are the above-mentioned spray and MIKROJET applicators, and, in the present case even more favorably, a film-transfer applicator, since this section of the papermaking machine has more free space than the press section for adapting an applicator thereto. A benefit of a film-transfer applicator is its field-proven functionality and controllability. Still, it may be problematic to achieve good penetration of high solids size into the base web except when the furnish is prepared rich with water. Hence, after the applicator apparatus is located a press roll nip that ensures penetration of size into the base web. The roll nip may be simply a group of two press roll nips or a single extended-nip press. However, if a film-transfer press is used, the press roll nip may be redundant. By modifying the retention time between size application and the instant of pressing, it is possible to affect size penetration and smoothness of the applied size layer on the opposite sides of the web.

Since a major portion of the size is already introduced into the web at an earlier state and the solids in the size applied in the latter stage is high, the amount of water imported to the web remains small, whereby it is sufficient to complement the last step of size application with minor drying that can be carried out using, e.g., a dryer group 7 comprising only a few heatable cylinders. On the other hand, it may be contemplated that size application taking place at surface size applicator 4 is adapted to occur in the middle of the dryer section, whereby the dryer cylinder group downstream of size applicator 4 is incorporated in the dryer section.

Size penetration and web porosity are essentially affected by the running speed difference between the press section and the dryer section. As already mentioned above, the moisture content of the web at this stage is still rather high at about 60%, whereby the web and its fibers are readily workable and the deformations thereof are permanent. Conventionally the dryer section has been run at a slightly higher speed than the press section to ensure good adherence of the web on the rolls and secure unproblematic run of the web in the machine. With the help of modern machine control systems and web guidance arrangements, the web can be run at a smaller draw than prior papermaking machines. In fact, it has been found that size penetration and the end product quality may be varied by controlling the draw between the press section and the dryer section. In addition to affecting other web surface properties, the porosity of the web surface controls size penetration into the base web. Hence, draw control may be utilized as a means to control size penetration and the properties of the end product. Inasmuch as it is still unknown how a change in web porosity affects the end product quality and size penetration therein, a suitable value of draw must be found by experimental techniques.

Figure 2:
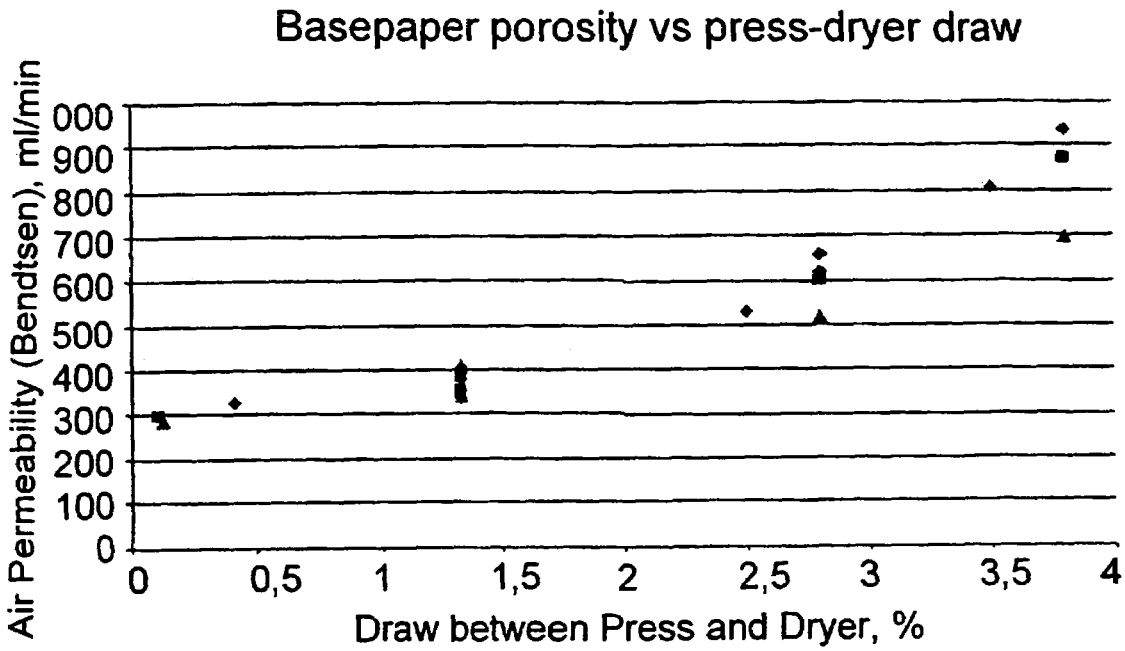
FIG. 2 shows a graph illustrating the effect of draw between the press section and the dryer section on the porosity of the base web.

FIG. 2 shows changes in web porosity in a graph illustrating air permeability as a function of draw. As can be seen from the graph, web porosity stays close to the basic value of web porosity as formed on the press section until a draw of about 1.5% is attained, whereupon porosity begins to increase. The rate of porosity increase is accelerated at draws exceeding 2.5%. The upper limit of usable draw and, hence, the maximum attainable porosity is set by the ultimate strength of the base web.

In addition to those described above, the present invention may have alternative embodiments.

In principle, the headbox may be adapted to mix size to any of the layers formed in the web. Since the web surface layers can be sized also at later stages, size addition in the middle layer of the web is most advantageously performed at the headbox. Size may be added in a single-layer headbox, too. The advantage of increasing base web strength by size must be weighed as the price ratio of starch or other size to fiber stock. The solids content of size furnish may be kept very low at the headbox and the press section since the water content of the web at these points is very high, whereby additional water from the size furnish does not significantly affect the operation of the press section. However, an important detail to be noted in size application downstream of the dryer section is that, at this stage, a major portion of size has already been applied to the web and, hence, the solids content of size being applied later can be high. If so desired, the final size application may be divided into multiple steps wherein size is applied in several layers.

In addition to or in lieu of the dryer cylinder groups mentioned above, it is possible particularly after the last size application step to use, e.g., noncontact type dryers. Furthermore, to a person skilled in the art it is obvious that the invention is not limited to the manufacture of finished paperboard or paper products only, but the web treated according to the invention may further be coated or calendered as necessary using on-line tai off-line equipment.

What is claimed is:

1. A method for manufacturing a sized web of paper or paperboard, the method comprising:

forming the web at a headbox from a stock comprising at least water and fiber;

pressing the formed web to drain water therefrom;

drying the pressed web by heating;

applying at least a portion of an overall amount of size to the web prior to initiating the drying of the web by heating; and applying at least a portion of the overall amount of size to the web surface after initiating the drying of the web, wherein at least a portion of the size is applied to the web by pressing during the step of pressing of the web.

2. The method of claim 1, wherein at least a portion of the size is added to the web by mixing the size in the stock in the headbox and at least a portion of the size is applied to the web by pressing during the drying step by pressing of the web.

3. The method of claim 2, wherein:

a three-layer headbox is used for web formation and size is added to the middle layer of the web, size is applied to one side of the web during pressing prior to taking the web to a last press nip of a press section in which the web is pressed, water drainage from the web takes place on the unsized side of the web, and size is added to the untreated side of the web after drying the web by heating and then excess moisture imparted to the web by the applied size is removed.

4. The method of claim 1, wherein the size applied to the web after heating employs a size furnish having a solids content of 15 to 40% and the amount of size applied to the web is not greater than 5 $g/m^2$ as aqueous furnish of size applied to the web.

5. The method of claim 1, wherein web porosity is adjusted to a desired value by controlling draw between pressing of the web and heating of the web.

6. The method of claim 5, wherein the draw is adjusted to a value of 0% to 1.5% in order to attain low porosity, to 1.5% to 2.5% for increased porosity, and to a value greater than 2.5% for highly increased porosity.

7. The method of claim 1, wherein size is applied to the web surface by means of a spray or jet applicator.

8. The method of claim 1, wherein size is applied to the web by means of a spray, jet, or film-transfer applicator after drying of the web by heating is initiated.

9. An apparatus for manufacturing a sized web of paper or paperboard, comprising:

a headbox forming a web from a stock comprising at least water and fiber;

a press section for draining water from the web;

a dryer section for drying the web by heating;

a first size applicator for applying size to the web prior to entry of the web to a first stage of the dryer section; and a second size applicator for applying size to the web surface after the first stage of the dryer section;

wherein at least one size applicator operates on the press section prior to a last nip of the press section.

10. The apparatus of claim 9, wherein the headbox comprises a multilayer headbox, wherein size can be added to at least one stock layer of a web.

11. The apparatus of claim 9, wherein at least one size applicator is a spray applicator or a jet applicator.

12. The apparatus of claim 9, wherein the second size applicator is downstream of the dryer section, the second size applicator comprising a size applicator and at least one nip for pressing the applied size into pores of the web.

13. The apparatus of claim 12, wherein the second size applicator is a spray applicator or a jet applicator.

14. The apparatus of claim 9, wherein the second size applicator is a film-transfer applicator.

* * * * *